US010533738B2

(12) United States Patent
Leung et al.

(10) Patent No.: US 10,533,738 B2
(45) Date of Patent: Jan. 14, 2020

(54) SYSTEMS AND METHODS FOR WATER-RESISTANT LAMP HOLDERS

(71) Applicant: POLYGROUP MACAU LIMITED (BVI), Road Town, Tortola (VG)

(72) Inventors: Chi Yin Alan Leung, Chai Wan (HK); Chi Kin Samuel Kwok, Shenzhen (CN); Changjun He, Shenzhen (CN)

(73) Assignee: POLYGROUP MACAU LIMITED (BVI), Road Town (VG)

( * ) Notice: Subject to any disclaimer, the term of this patent is extended or adjusted under 35 U.S.C. 154(b) by 71 days.

(21) Appl. No.: 15/598,049

(22) Filed: May 17, 2017

(65) Prior Publication Data

US 2017/0336063 A1 Nov. 23, 2017

Related U.S. Application Data

(60) Provisional application No. 62/338,887, filed on May 19, 2016.

(51) Int. Cl.

| | |
|---|---|
| ***F21V 31/00*** | (2006.01) |
| ***F21S 4/10*** | (2016.01) |
| ***F21V 3/00*** | (2015.01) |
| ***F21V 23/00*** | (2015.01) |
| ***F21V 3/02*** | (2006.01) |
| ***F21W 121/00*** | (2006.01) |
| ***F21W 121/04*** | (2006.01) |
| ***F21Y 115/10*** | (2016.01) |

(52) U.S. Cl.

CPC ..... *F21V 31/005* (2013.01); *F21S 4/10* (2016.01); *F21V 3/00* (2013.01); *F21V 3/02* (2013.01); *F21V 23/001* (2013.01); *F21W 2121/00* (2013.01); *F21W 2121/04* (2013.01); *F21Y 2115/10* (2016.08)

(58) Field of Classification Search

CPC ..... F21S 4/10; F21V 23/001; F21V 31/005; F21V 3/00; F21V 3/02; F21W 2121/00; F21W 2121/04; F21Y 2115/10

See application file for complete search history.

(56) References Cited

U.S. PATENT DOCUMENTS

| | | | |
|---|---|---|---|
| 4,631,650 | A | 12/1986 | Ahroni |
| 4,675,575 | A | 6/1987 | Smith et al. |

(Continued)

FOREIGN PATENT DOCUMENTS

| | | | |
|---|---|---|---|
| CN | 202125779 | U | 1/2012 |
| CN | 202165901 | U | 3/2012 |
| EP | 1384942 | A1 | 1/2004 |

OTHER PUBLICATIONS

EP Search Report from Related European Patent Application No. 17171665.7, Apr. 7, 2017, 10 pages.

*Primary Examiner* — Tsion Tumebo

(74) *Attorney, Agent, or Firm* — Troutman Sanders LLP; Ryan A. Schneider; Christopher C. Close, Jr.

(57) ABSTRACT

The disclosed technology includes a water-resistant lamp assembly for preventing interference with the operation of an electric lamp due to leaks. The water-resistant lamp assembly may include a gasket that provides a seal with the bottom of the base of the lamp holder to prevent water from entering the internal cavity of the lamp holder. The gasket may further shield internal electrical conductors from exposure to water that has leaked into the internal cavity of the lamp holder.

11 Claims, 7 Drawing Sheets

(56) References Cited

U.S. PATENT DOCUMENTS 4,720,773 A 1/1988 Ahroni
4,736,282 A 4/1988 Ahroni
4,777,573 A 10/1988 Liao
4,779,177 A 10/1988 Ahroni
4,807,098 A 2/1989 Ahroni
4,899,266 A 2/1990 Ahroni
5,051,877 A 9/1991 Liao
5,109,324 A 4/1992 Ahroni
5,121,310 A 6/1992 Ahroni
5,154,508 A 10/1992 Ahroni
5,228,774 A 7/1993 Liao
5,366,386 A 11/1994 Liao
5,394,315 A 2/1995 Ahroni
5,542,858 A 8/1996 Liao
5,620,343 A * 4/1997 Pan ..... H01R 33/09 439/602
5,681,107 A * 10/1997 Wang ..... F21V 21/002 362/249.01
5,700,082 A 12/1997 Peng
5,720,544 A * 2/1998 Shu ..... F21V 31/00 362/267
5,820,419 A * 10/1998 Liao ..... H01R 33/09 439/699.2
5,829,865 A 11/1998 Ahroni
6,079,848 A 6/2000 Ahroni
6,183,310 B1 * 2/2001 Shu ..... F21V 19/0005 439/699.2
6,200,169 B1 * 3/2001 Tseng ..... H01R 33/09 439/619
6,416,203 B1 7/2002 Fan Wong
6,609,814 B2 8/2003 Ahroni
7,784,993 B2 8/2010 Yu
7,798,844 B2 * 9/2010 Li ..... F21V 19/0005 439/460
7,883,261 B2 2/2011 Yu
7,955,119 B2 * 6/2011 Li ..... F21V 19/0005 439/460
7,963,670 B2 6/2011 Yu
8,070,347 B1 12/2011 Lin
8,083,393 B2 12/2011 Yu
8,376,606 B2 2/2013 Yu
8,388,213 B2 3/2013 Yu
8,469,750 B2 6/2013 Chen
8,746,953 B1 6/2014 Shao
8,747,167 B2 6/2014 Chen
2007/0080619 A1 4/2007 Lu
2007/0183153 A1 8/2007 Yu
2008/0143234 A1 * 6/2008 Yu ..... F21V 17/06 313/318.08
2010/0073963 A1 3/2010 Yu
2012/0033439 A1 2/2012 Liu et al.
2015/0211726 A1 7/2015 Wu Lee
2015/0211727 A1 7/2015 Loomis et al.
2016/0010814 A1 1/2016 Peng

* cited by examiner

SYSTEMS AND METHODS FOR WATER-RESISTANT LAMP HOLDERS

CROSS-REFERENCE TO RELATED APPLICATIONS

This application claims priority to, and the benefit under 35 U.S.C. § 119(e) of, U.S. Provisional Patent Application Ser. No. 62/338,887, filed on 19 May 2016, entitled "Systems and Methods for Water Resistant Lamp Holders," the contents of which are hereby incorporated by reference in their entirety as if fully set forth below.

TECHNICAL FIELD

Aspects of the present disclosure relates to an electric lamp assembly, and, more particularly, a water-resistant electric lamp assembly.

BACKGROUND

Electric lamps, such as light-emitting diodes ("LEDs"), are commonly used in decorative light strings, which are often used to decorate Christmas trees. But decorative light strings also may be used in other circumstances, such as to decorate a user's yard or the outside of a user's house. Accordingly, it may be desirable to provide a decorative light string suitable for use outdoors.

Conditions of outdoor use of decorative light strings may differ significantly from conditions of indoor use. For example, when used outdoors, decorative light strings may be subject to a variety of weather conditions, such as wind and rain. Due to the construction and manufacturing process, an electric lamp assembly on a decorative light string may not be entirely sealed and may allow water or moisture to leak into the internal compartment of the lamp assembly, which may interfere with the electrical components. For example, in a typical lamp assembly, wires may exit the lamp assembly through holes in the base of the lamp assembly, and these holes may provide space for water to enter the internal compartment of the lamp assembly. This area may be particularly susceptible to leaks as in some cases the wires exiting the lamp assembly may serve to guide water running down the wires directly into the internal compartment of the lamp assembly. As will be appreciated, water that enters the internal compartment of the lamp assembly may cause damage to the assembly or a malfunction of the assembly, such as a short circuit.

BRIEF DESCRIPTION OF THE FIGURES

Reference will now be made to the accompanying figures, which are not necessarily drawn to scale, and wherein.

DETAILED DESCRIPTION

Figure 1A:
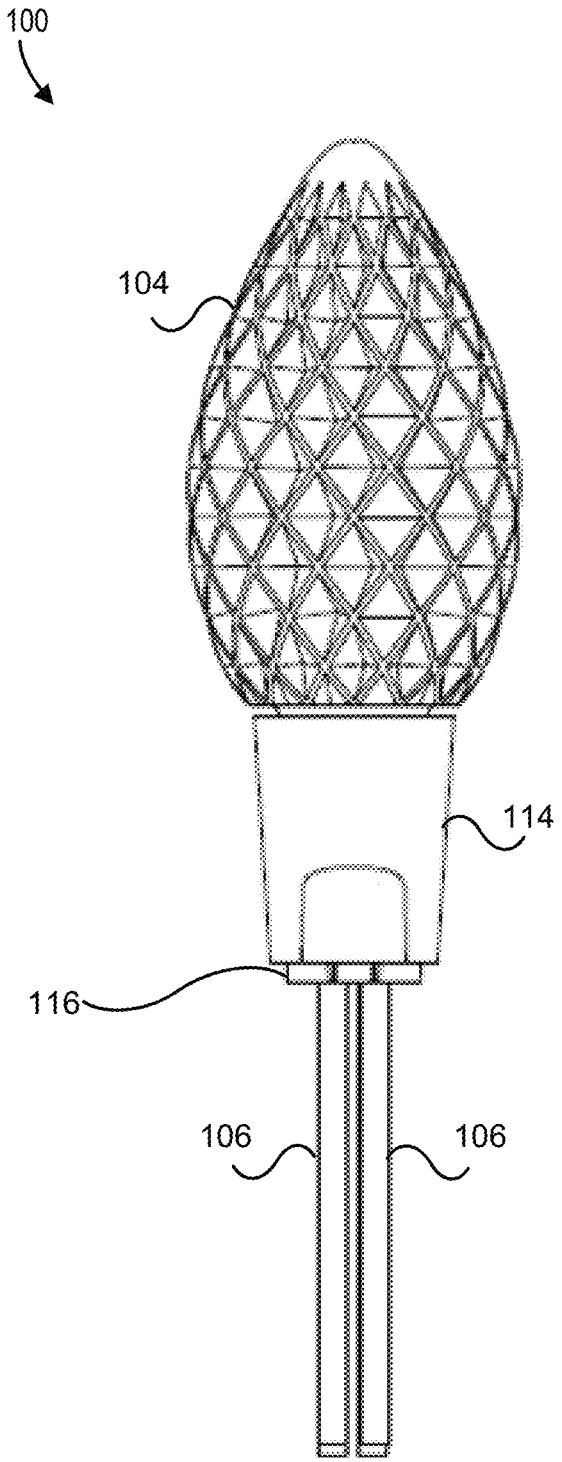
FIG. 1A is a front view of a lamp assembly, in accordance with an example embodiment of the presently disclosed subject matter.

The present disclosure can be understood more readily by reference to the following detailed description of exemplary embodiments and the examples included herein. Before the exemplary embodiments of the devices and methods according to the present disclosure are disclosed and described, it is to be understood that embodiments are not limited to those described within this disclosure. Numerous modifications and variations therein will be apparent to those skilled in the art and remain within the scope of the disclosure. It is also to be understood that the terminology used herein is for the purpose of describing specific embodiments only and is not intended to be limiting. Some embodiments of the disclosed technology will be described more fully hereinafter with reference to the accompanying figures. This disclosed technology may, however, be embodied in many different forms and should not be construed as limited to the embodiments set forth therein.

In the following description, numerous specific details are set forth. But it is to be understood that embodiments of the disclosed technology may be practiced without these specific details. In other instances, well-known methods, structures, and techniques have not been shown in detail in order not to obscure an understanding of this description. References to "one embodiment," "an embodiment," "example embodiment," "some embodiments," "certain embodiments," "various embodiments," etc., indicate that the embodiment(s) of the disclosed technology so described may include a particular feature, structure, or characteristic, but not every embodiment necessarily includes the particular feature, structure, or characteristic. Further, repeated use of the phrase "in one embodiment" does not necessarily refer to the same embodiment, although it may.

Unless otherwise noted, the terms used herein are to be understood according to conventional usage by those of ordinary skill in the relevant art. In addition to any definitions of terms provided below, it is to be understood that as used in the specification and in the claims, "a" or "an" can mean one or more, depending upon the context in which it is used. Throughout the specification and the claims, the following terms take at least the meanings explicitly associated herein, unless the context clearly dictates otherwise. The term "or" is intended to mean an inclusive "or." Further, the terms "a," "an," and "the" are intended to mean one or more unless specified otherwise or clear from the context to be directed to a singular form.

Unless otherwise specified, the use of the ordinal adjectives "first," "second," "third," etc., to describe a common object, merely indicate that different instances of like objects are being referred to, and are not intended to imply that the objects so described must be in a given sequence, either temporally, spatially, in ranking, or in any other manner.

Also, in describing the exemplary embodiments, terminology will be resorted to for the sake of clarity. It is intended that each term contemplates its broadest meaning as understood by those skilled in the art and includes all technical equivalents that operate in a similar manner to accomplish a similar purpose.

To facilitate an understanding of the principles and features of the embodiments of the present disclosure, exemplary embodiments are explained hereinafter with reference to their implementation in an illustrative embodiment. Such illustrative embodiments are not, however, intended to be limiting.

The materials described hereinafter as making up the various elements of the embodiments of the present disclosure are intended to be illustrative and not restrictive. Many suitable materials that would perform the same or a similar function as the materials described herein are intended to be embraced within the scope of the exemplary embodiments. Such other materials not described herein can include, but are not limited to, materials that are developed after the time of the development of the invention, for example.

Embodiments of the disclosed technology include a water-resistant lamp assembly for preventing fluids from entering the internal compartment of the lamp assembly. In various embodiments, a water-resistant lamp assembly may provide a seal to prevent water from entering the lamp assembly and may provide protection for the internal components of the assembly should water enter.

Throughout this disclosure, certain embodiments are described in exemplary fashion in relation to a lamp assembly on a decorative light string. However, embodiments of the disclosed technology are not so limited. In some embodiments, the disclosed technique may be effective in other types of electric lamp assemblies, such as outdoor lamp fixtures.

Referring now to the drawings, FIG. 1A illustrates an example embodiment of a fully assembled water-resistant lamp assembly 100. According to some embodiments the water-resistant lamp assembly 100 may be connected to a decorative light string. The water-resistant lamp assembly may house and protect an electric light source that may provide illumination or decorative lighting. As shown in FIG. 1A, in some embodiments, a water-resistant lamp assembly 100 may include a lamp base 114, an outer bulb 104, one or more external electrical conductors 106, and a gasket 116, which will be discussed further herein.

Figure 1B:
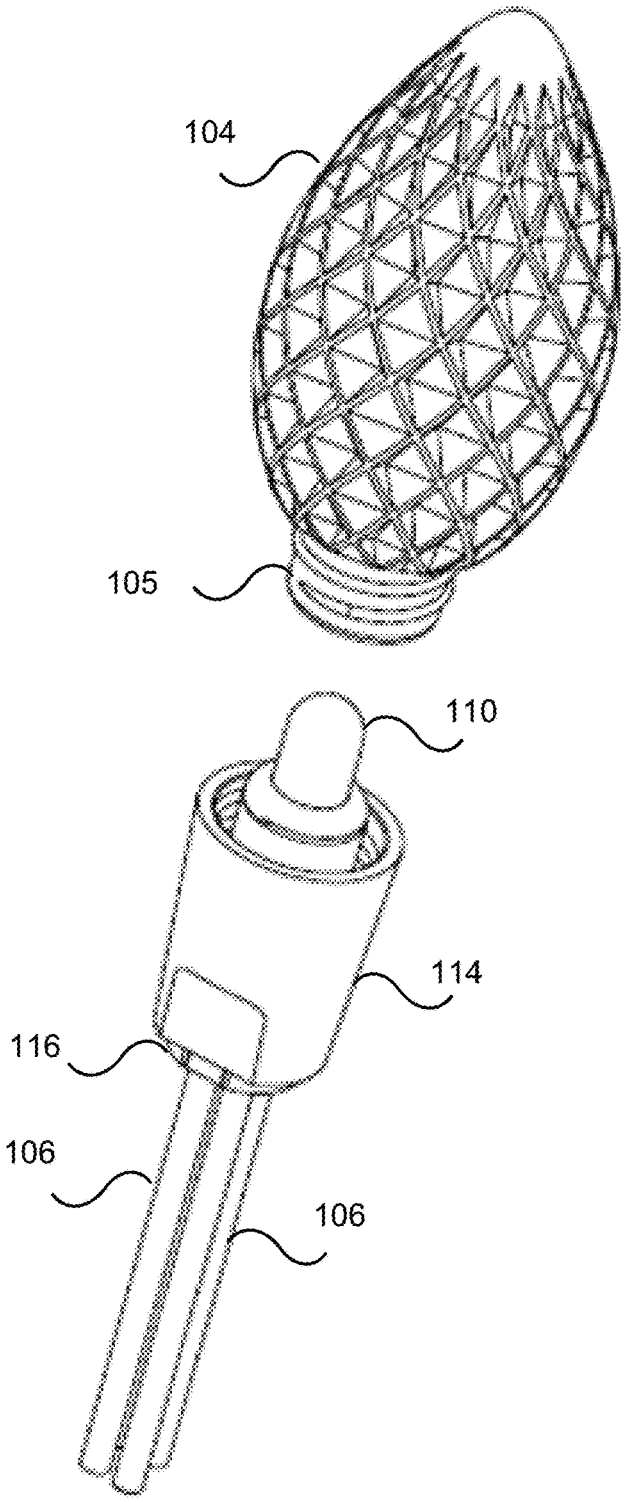
FIG. 1B is an exploded perspective view of a lamp assembly, in accordance with an example embodiment of the presently disclosed subject matter.

As shown in FIG. 1B, the outer bulb 104 may be detachably attached to the lamp base 114. Accordingly, in some embodiments, a lower portion 105 of the outer bulb 104 may attach to the lamp base 114 such that the lamp base 114 can securely hold the outer bulb 104. For example, as shown in FIGS. 1B-E, the lower portion 105 may be threaded and the lamp base 114 may include threading such that the outer bulb 104 may screw into the lamp base 114, thus providing a seal to prevent leaking. Alternatively, the lower portion 105 may be configured such that the outer bulb 104 can snap into the lamp base 114, be secured by tabs that slide into receiving slots of the lamp base 114, or be secured to the lamp base 114 by any other similar method.

Figure 1C:
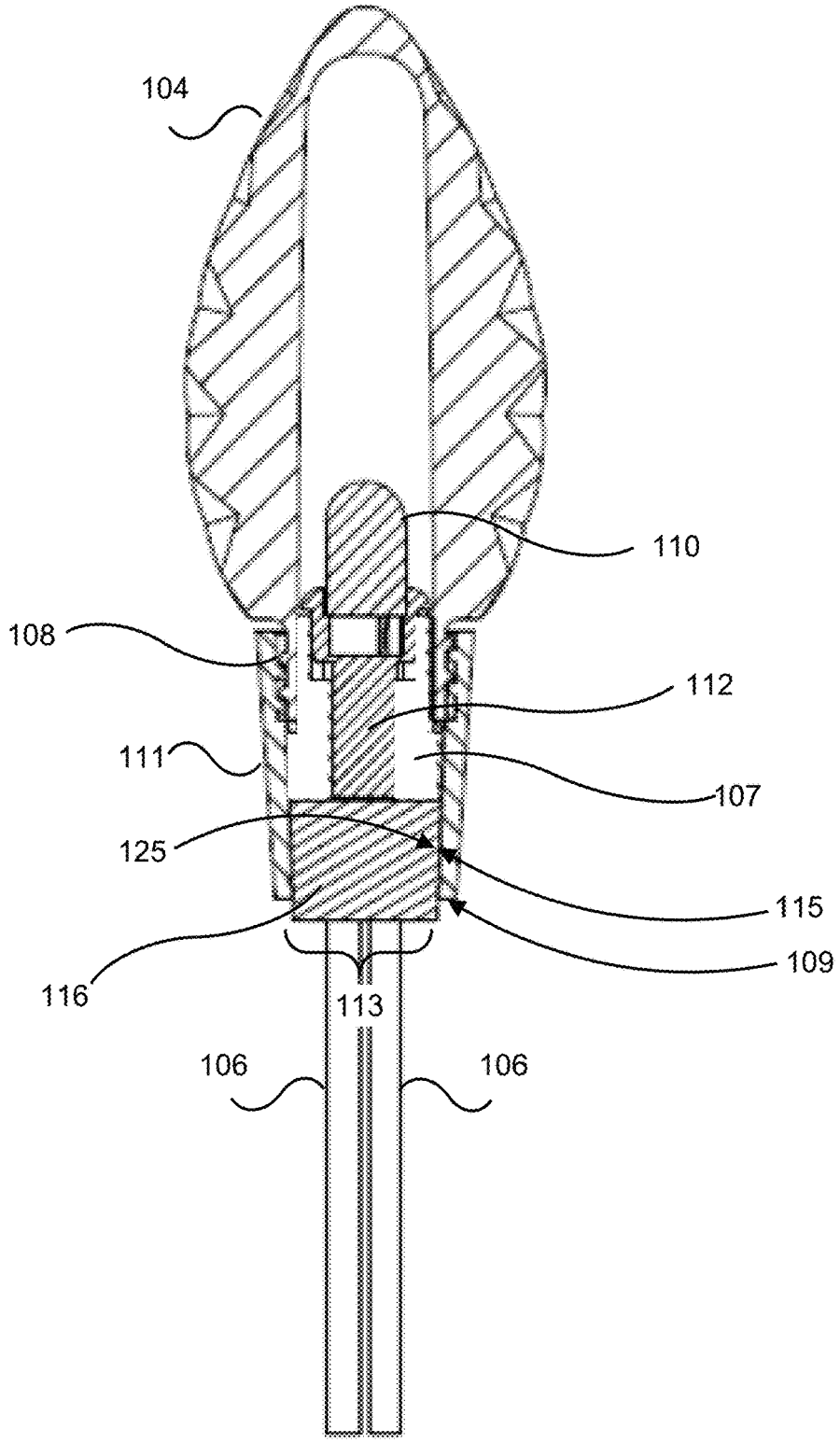
FIG. 1C is a cross-sectional view of a lamp assembly, in accordance with an example embodiment of the presently disclosed subject matter

According to some embodiments, a lamp base 114 may house a light source or lamp 110, such as, for example, an LED or incandescent lamp. As shown in FIGS. 1C & 1E, in some embodiments, a lamp base 114 may house a lamp 110, internal electrical conductors 112, and a gasket 116. In some embodiments, the internal electrical conductors 112 may be electrically connected to, or an extension of, the external electrical conductors 106. For example, according to some embodiments, the internal electrical conductors 112 may be coupled to the external electrical conductors 106 at a jack, a socket, or any other similar electrical connection apparatus. In some embodiments, internal electrical conductors 112 may be continuous wires that also form the external electrical conductors 106. In some embodiments, the external electrical conductors 106 may be insulated. In some embodiments, the internal electrical conductors 112 may lack insulation. For example, in some embodiments internal electrical conductors 112 may be naked wires. According to some embodiments, the internal electrical conductors 112 may be electrically connected to the lamp 110 and may supply electrical power to the lamp 110.

In some embodiments, one or more external electrical conductors 106 may lead into the lamp base 114. For example, as shown in FIG. 1C, the base 114 may have a bottom portion 109 and one or more walls 111 that extend upwards from the bottom portion 109 in direction that may be approximately perpendicular to the bottom portion 109. The bottom portion 109 and the one or more walls 111 of the base 114 may define a hollow cavity. In some embodiments, the bottom portion 109 of the base 114 may include one or more apertures 113 for receiving electrical conductors (e.g. external electrical conductors 106). According to some embodiments, the lamp base 114 may receive one or more external electrical conductors 106 through the one or more apertures 113 in the bottom portion 109.

In some embodiments, the one or more external electrical conductors 106 may be insulated wires. The external electrical conductors 106 may provide electrical power to the lamp assembly 100 and may be a part of, for example, a light string, or may be connected to, for example, an electrical outlet or another power source. In some embodiments, the external electrical conductors 106 may also include one or more signal wires that may provide signals to the lamp assembly that may control the lamp assembly.

The lamp 110 may be a lighting element that provides a source of light or illumination. According to some embodiments, the lamp 110 may be an LED, an incandescent bulb, fluorescent bulb, or any other suitable lighting element. According to some embodiments, as shown in FIGS. 1B-1E, the lamp 110 may be partially housed within the base 114. For example, in some embodiments, the base 114 may define a hollow cavity (or space) within which the lamp 110 may be seated. In some embodiments, the lamp 110 may be fully housed within the base 114. In some embodiments, the light-emitting portion of the lamp 110 may be positioned such that it extends vertically above the base 114 and into an internal cavity of the outer bulb 104.

As shown in FIG. 1C, positioning the lamp 110 and/or internal conductors 112 inside the base 114 can create a hollow space 107 between the outer surfaces of the lamp 110 and/or internal electrical conductors 112 and the internal surface 115 of the walls of the base 114. As will be understood, such hollow spaces 107 may provide a space for water to accumulate if water were to leak into the internal cavity of the lamp holder 102. As will be appreciated, if water were to accumulate within a hollow space provided by the base 114, such water may come into contact with the internal electrical conductors 112 and/or the lamp 110 and may interfere with the proper functioning of the lamp 110.

Figure 1D:
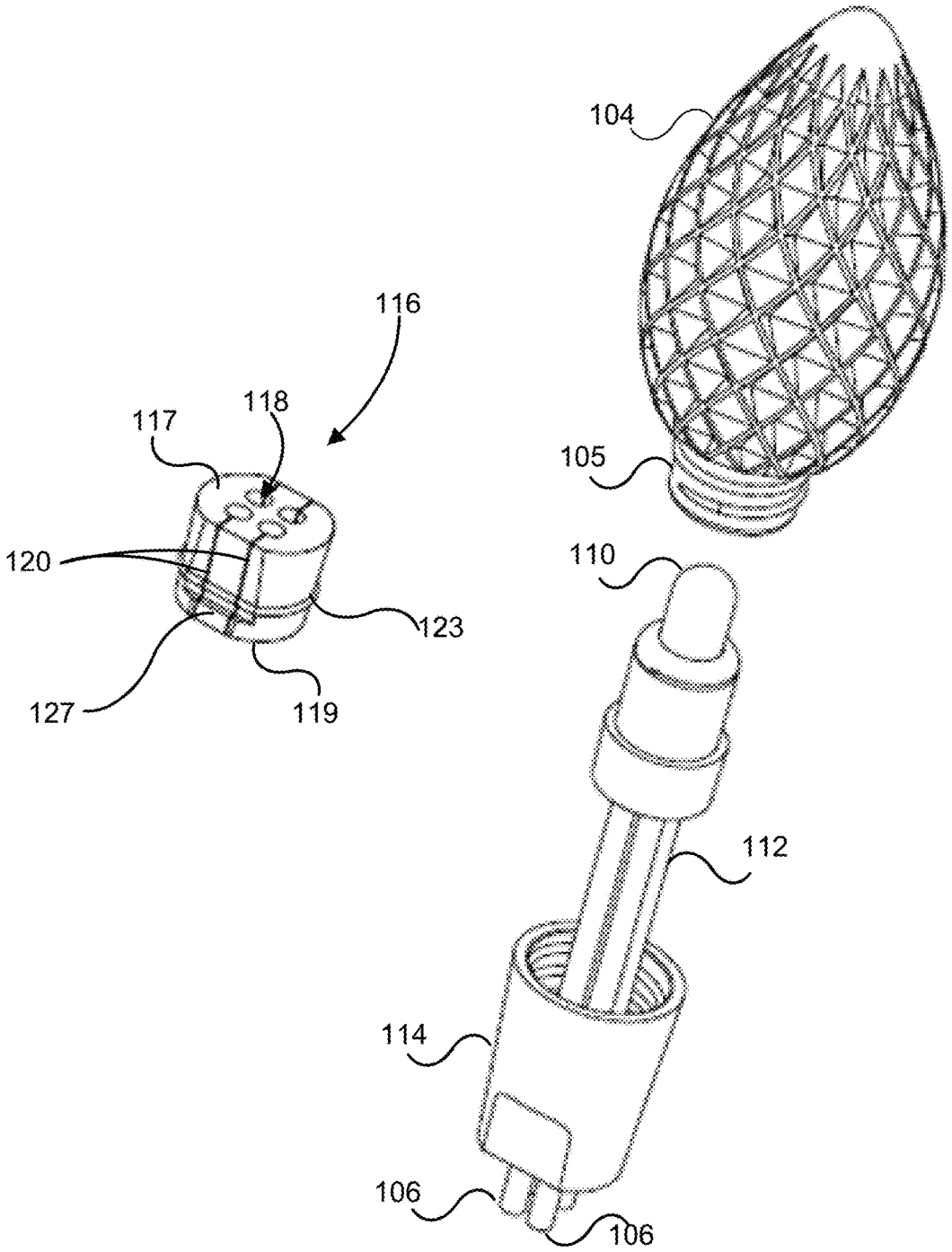
FIG. 1D is an exploded perspective view of a lamp assembly, in accordance with an example embodiment of the presently disclosed subject matter.
Figure 1E:
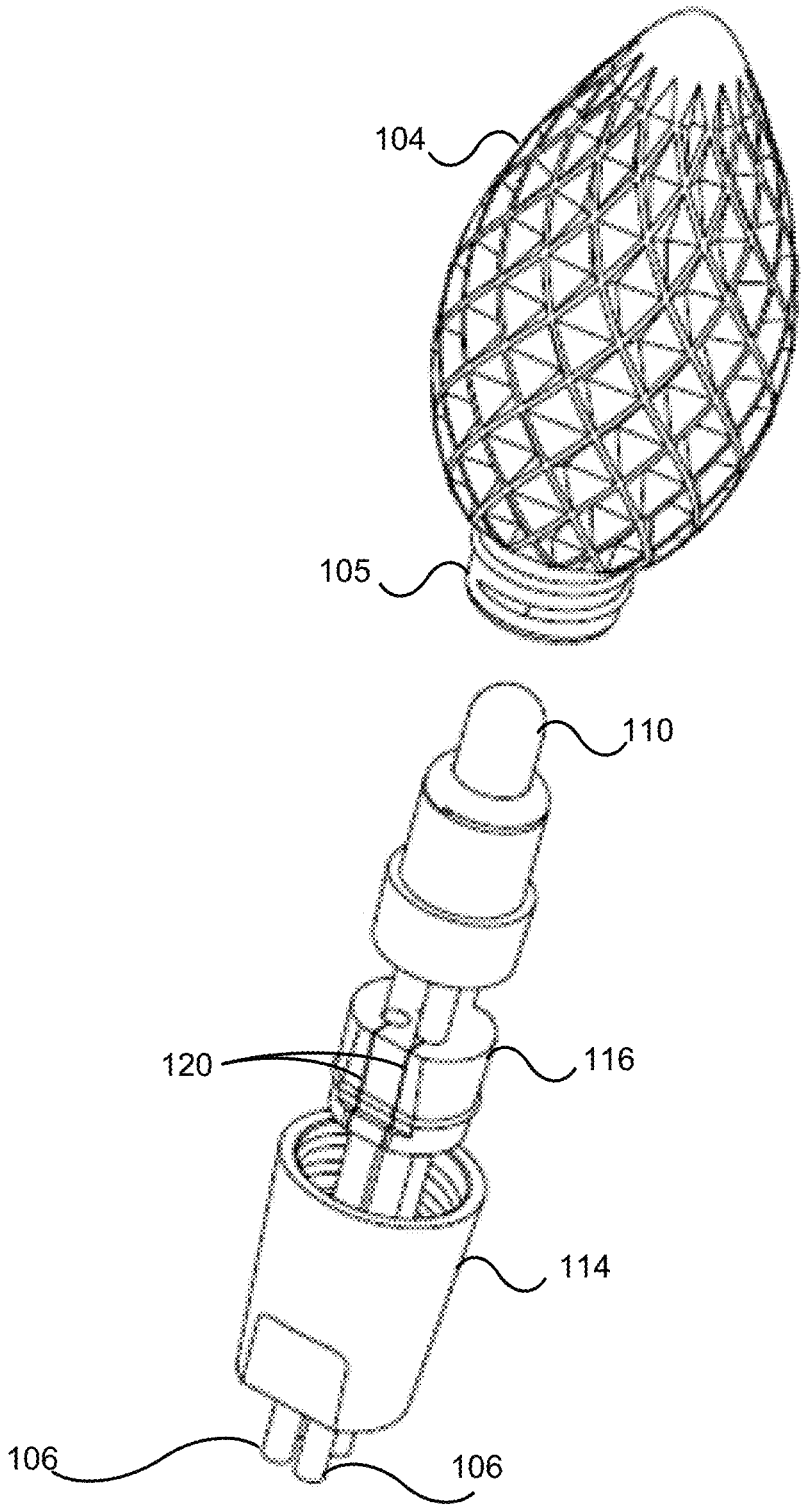
FIG. 1E is an exploded perspective view of a lamp assembly, in accordance with an example embodiment of the presently disclosed subject matter.

As shown in FIG. 1D and according to some embodiments, a gasket 116 may be included inside the base 114 to prevent improper functioning of the lamp due to water. A gasket 116 may serve to prevent water (or any other fluid or liquid) from entering the internal cavity of the lamp base 114. In other embodiments, a gasket 116 may serve to provide insulation and protection to the internal electrical conductors 112 in the event that water does manage to otherwise leak into the internal cavity of the lamp base 114, thereby serving to prevent disruption to the operation of the lamp 110. For example, if the electrical connection between the external electrical conductors 106 and internal electrical conductors 112 occurs inside the gasket 116, water inside the lamp base 114 should not come into contact with the any exposed conductors, and therefore should not interfere with the proper functioning of the lamp.

According to some embodiments and as shown in FIG. 1D, a gasket 116 may have a three-dimensional shape having a top surface 117, a bottom surface 119, and a body 121. For example, in some embodiments, a gasket 116 may have the shape of a box or a cylinder. As shown in FIG. 1C, a gasket 116 may be sized to be positioned within the base 114 such that the walls 125 of the gasket 116 are substantially flush against the internal surface 115 of the walls of the base 114. In some embodiments, the gasket 116 may be sized such that when inserted into the base 114, there is a hollow space between the outer walls 125 of the gasket 116 and the internal surface 115 of the walls of the base 114. According to some embodiments, the bottom surface 119 of the gasket may be positioned flush against the walls or internal surface of the bottom portion 109 of the base 114. In other embodiments, the bottom surface 119 of the gasket 116 may extend through the aperture (or apertures) 113 in the bottom surface 109 of the lamp base 114. In yet other embodiments and as shown in FIG. 1D, the gasket may have a raised portion 123 such that when the gasket 116 extends through the apertures 113 in the bottom surface 109 of the lamp base 114, the raised portion 123 will come into contact with the internal surface 115 of the walls of the base 114, thus creating a seal. Accordingly, the bottom surface 119 of the gasket 116 may act to prevent liquids from leaking in through one or more apertures 113 in the bottom portion 109 of the base 114 by providing a seal between the gasket 116 and walls or the bottom of the base 114, as shown in FIG. 1C.

In some embodiments and as shown in FIGS. 1D & 1E, the gasket 116 may include one or more apertures 118. The one or more apertures 118 may span the entire height of the gasket 116, from the top surface 117 to the bottom surface 119. According to some embodiments, the one or more apertures 118 may receive one or more internal electrical conductors 112 that extend out of the lamp 110. In some embodiments, the gasket 116 may enable or facilitate the electrical connection between the internal electrical conductors 112 and the external electrical conductors 106. For example, in some embodiments, the gasket 116 may receive the external electrical conductors 106 via apertures 118 in the bottom surface 119 of the gasket 116 and may receive the internal electrical conductors 112 via the apertures 118 in the top surface 117 of the gasket 116. Accordingly, in some embodiments, the internal electrical conductors 112 may come into contact with the external electrical conductors 106 within the gasket 116. In some embodiments, the gasket 116 may include a jack, a socket, or any other similar electrical connection apparatus that receives and electrically connects the internal electrical conductors 112 and the external electrical conductors 106.

According to some embodiments, internal electrical conductors 112 may be inserted into the apertures 118 of the gasket 116 by plugging them in. For example, for a lamp 102 comprising an LED, the LED may have electrical leads or conductors 112 that may be plugged into the apertures 118 of gasket 116. Accordingly, in some embodiments, the lamp 102 may be removably attached to the gasket 116. The internal electrical conductors 112 may be snuggly received by the apertures 118 of the gasket 116. In instances where the internal electrical conductors 112 are naked wires or leads, the gasket 116 may provide the benefit of shielding the naked wires/leads from exposure to, for example, water that may have leaked into the internal cavity of the lamp base 114. According to some embodiments, gasket 116 may receive the entirety of the internal electrical conductors 112, such that there is no part of the internal electrical conductors 112 remains exposed to the hollow cavity of the base 114.

Figures 2A, 2B:
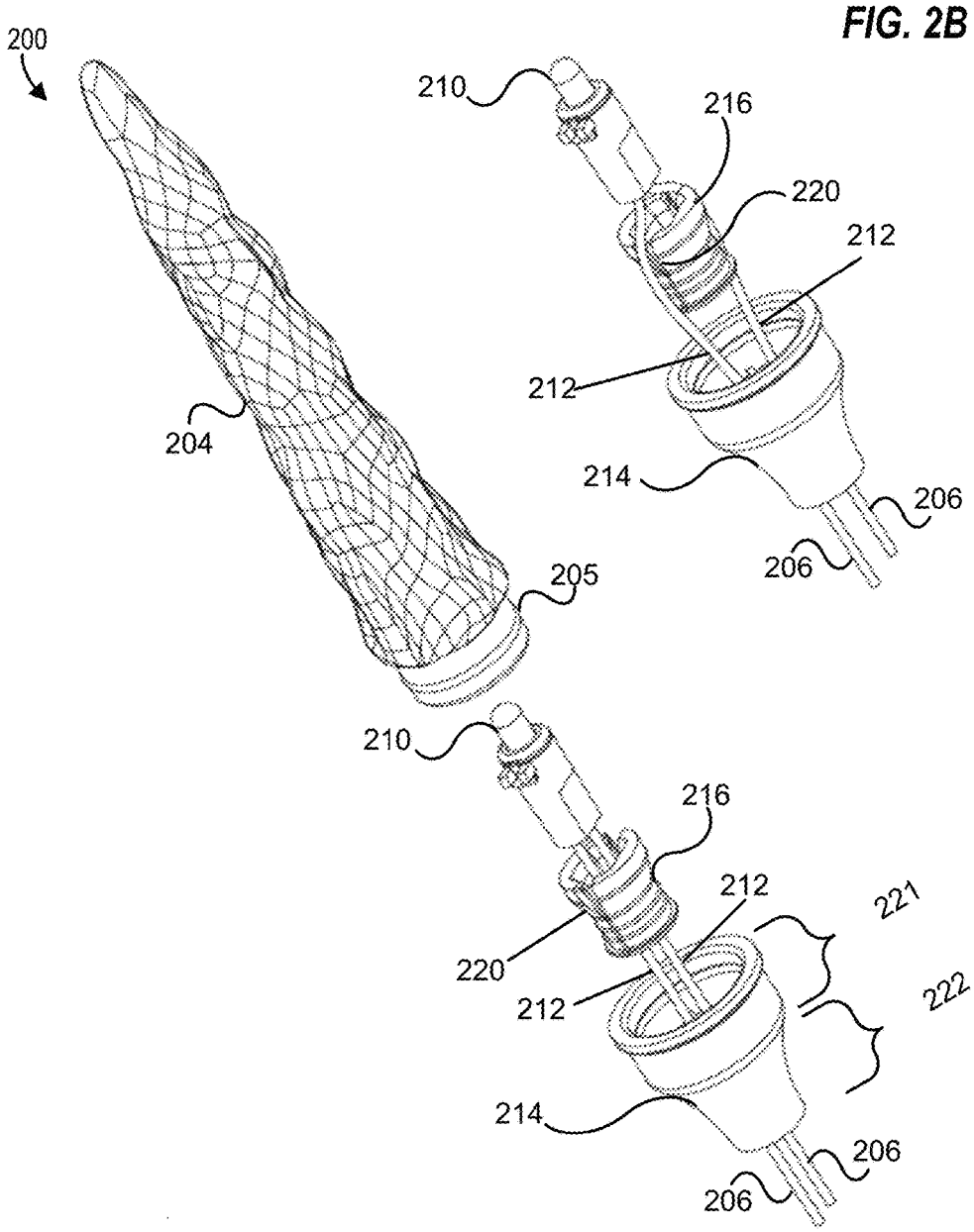
FIG. 2A is an exploded perspective view of a lamp assembly, in accordance with an example embodiment of the presently disclosed subject matter.
FIG. 2B is a perspective view of a portion of a lamp assembly, in accordance with an example embodiment of the presently disclosed subject matter.

In some embodiments, it may not be possible to plug an internal electrical conductor 112 into the gasket 116 as is shown in FIG. 2A, for example, in an instance where an internal electrical conductor 112 and an external electrical conductor 106 are formed from a single continuous wire. Accordingly, in some embodiments as is shown in FIG. 2B, the gasket 116 may include one or more slits 120 that can laterally receive the internal electrical conductors 112. As shown in FIGS. 1D & 1E, in some embodiments, the gasket 106 may have slits 120 that run from the top surface 117 of the gasket 116 to the bottom surface 119 of the gasket 116, along one or more side faces 127 of the body 121 of the gasket 116. Each slit 120 may extend from an external face of the body 121 of the gasket 116 to an aperture 118. Accordingly, an internal electrical conductor 112 may be placed into an aperture 118 by sliding it laterally through a slit 120. The gasket 116 may be made from a deformable material that is capable of returning to its original shape. As such, the gasket 116 may be flexible such that a slit 120 temporarily deforms and increases in size to accommodate the passing an internal electrical conductor 112 through the channel formed by a the slit 120. Once the internal electrical conductor 112 has been received by the aperture 118, the nature of the material used for the gasket 116 may cause the slit 120 to return to its original size and the internal electrical conductor 112 may be snuggly secured by the gasket 116. The gasket may be made of rubber, plastic, a composite material, or any other suitable material that is rigid, but provides a degree of flexibility.

Figure 2C:
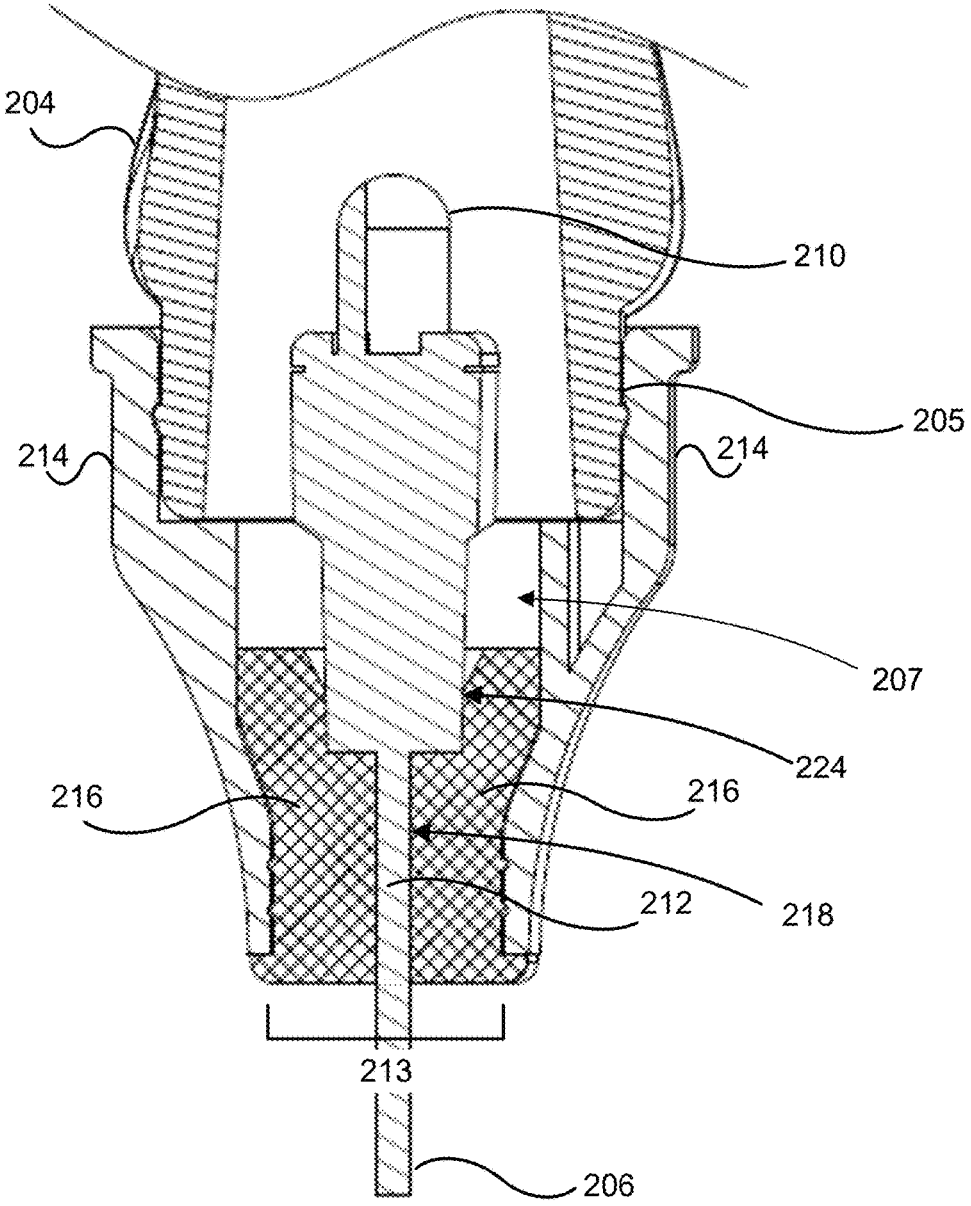
FIG. 2C is a cross-sectional view of a portion of a lamp assembly, in accordance with an example embodiment of the presently disclosed subject matter.

FIGS. 2A-C illustrate another example embodiment of a water-resistant lamp assembly 200. According to some embodiments, the lamp 210 may include a printed circuit board assembly (PCBA). One or more different LED lamps may be controlled by the PCBA, which is not shown, but its placement would be apparent to one skilled in the art, such that the lamp 210 may create different lighting effects, such as dripping water, or a shooting star effect. In some embodiments, the base 214 may generally have a funnel or cone shape, such that the width or circumference of the base 214 tapers toward the bottom. For example, as shown in FIG. 2A, in some embodiments, the base 214 may have a top region 221 having walls defining a hollow space, and a bottom region 222 having walls and a bottom defining a tapered or narrowing space. In some embodiments, the bottom surface of the base 214 may include one or more apertures through which external electrical conductors 206 may enter the internal cavity of the base 214. According to some embodiments, a gasket 216 may be sized to substantially occupy the bottom region 222 of the base 214. Accordingly, in some embodiments, the bottom surface of the gasket 216 may be positioned flush against the internal surface of the bottom of the base 214, which may create a seal preventing water from leaking in through apertures in the bottom of the base 214, as described above with respect to FIGS. 1A-E.

As shown in FIGS. 2A & 2B, in some embodiments, the gasket 216 may have one or more slits 220 that allow the gasket 216 to receive one or more internal electrical conductors 212 into one or more apertures 218, in a manner similar to that previously described above. FIG. 2B shows the internal electrical conductors 212 straddling the gasket 216 as they are about to be inserted into the gasket 216 through the slits 220. FIG. 2A shows the internal electrical conductors 212 after they have been received by the gasket 216.

FIG. 2C is a cross-sectional view of a water-resistant lamp assembly 200, showing that in some embodiments, the gasket 216 may include an aperture 218 that may allow one or more internal electrical conductors 212 to pass through the gasket 216. The aperture 218 may be a vertical channel designed to snuggly hold one or more internal electrical conductors 212. Furthermore, in some embodiments, the gasket 216 may include a mouth region 224 that may serve to receive a portion of the lamp 210. In some embodiments, the mouth region 224 may be an aperture larger than aperture 218. The mouth region 224 may be sized to receive and snuggly hold a lower portion of the lamp 210, as shown in FIG. 2C. Accordingly, in some embodiments, the lamp 210 may be seated in gasket 216 such that no portion of the internal electrical conductors 212 are exposed to the hollow cavity 207 of the base 214. Thus, the gasket 216 may serve to protect the lamp 210 from interference from leaks by surrounding and shielding the internal electrical conductors 212, and by providing a seal against the bottom of the base 214 to prevent water from entering through the apertures 213 in the base 214.

While certain embodiments of the disclosed technology have been described in connection with what is presently considered to be the most practical embodiments, it is to be understood that the disclosed technology is not to be limited to the disclosed embodiments, but on the contrary, is intended to cover various modifications and equivalent arrangements included within the scope of the appended claims. Although specific terms are employed herein, they are used in a generic and descriptive sense only and not for purposes of limitation.

This written description uses examples to disclose certain embodiments of the disclosed technology, including the best mode, and also to enable any person skilled in the art to practice certain embodiments of the disclosed technology, including making and using any devices or systems and performing any incorporated methods. The patentable scope of certain embodiments of the disclosed technology is defined in the claims, and may include other examples that occur to those skilled in the art. Such other examples are intended to be within the scope of the claims if they have structural elements that do not differ from the literal language of the claims, or if they include equivalent structural elements with insubstantial differences from the literal language of the claims.

What is claimed is:

1. A decorative lighting system comprising:

a power source;

at least one external electrical conductor;

at least one light string comprising a plurality of water-resistant electric lamp assemblies, each of the plurality of water-resistant electric lamp assemblies comprising:

a lamp base having an upper end, a lower end having a bottom surface, and a sidewall disposed therebetween, the sidewall and bottom surface creating a hollow cavity inside the lamp base;

an outer bulb detachably attachable to the lamp base;

a light source;

at least one internal electrical conductor; and a gasket adapted for placement into the hollow cavity, the gasket comprising (i) a top surface having a first plurality of apertures, (ii) a bottom surface having a second plurality of apertures, and (iii) an external face extending between the top surface and the bottom surface, wherein each aperture in the first plurality of apertures corresponds to a respective aperture in the second plurality of apertures to create a channel running between the respective aperture pair, each channel comprising a slit extending from the external face of the body of the gasket to the channel and configured to transition between a closed configuration corresponding to a first inner face of the slit abutting a second inner face of the slit and an open configuration corresponding to the first and second inner faces being spaced apart such that the at least one internal electrical conductor is permitted to pass laterally from outside the gasket to within a channel of a corresponding aperture pair;

wherein attaching the outer bulb to the lamp base creates a waterproof seal at the top of the lamp base;

wherein placing the gasket into the hollow cavity creates a waterproof seal at the lower end of the lamp base; and wherein the at least one external electrical conductor connects the plurality of water-resistant electric lamp assemblies to the power source.

2. A water-resistant electric lamp assembly comprising:

a lamp base having an upper end, a lower end having a bottom surface, and a sidewall disposed therebetween, the sidewall and bottom surface creating a hollow cavity inside the lamp base;

an outer bulb detachably attachable to the lamp base;

a light source;

one or more internal electrical conductors; and a gasket adapted for placement into the hollow cavity, the gasket comprising one or more slits, each slit of the one or more slits extending from a top surface of the gasket to a bottom surface of the gasket and being configured to laterally receive at least one of the one or more internal electrical conductors;

wherein attaching the outer bulb to the lamp base creates a waterproof seal at the top of the lamp base; and wherein placing the gasket into the hollow cavity creates a waterproof seal at the lower end of the lamp base.

3. The water-resistant electric lamp assembly of claim 2, wherein the top surface has a first plurality of apertures and the bottom surface has a second plurality of apertures, wherein each aperture in the first plurality of apertures corresponds to a respective aperture in the second plurality of apertures to create a channel running between the respective aperture pair, each channel being in communication with at least one of the one or more slits.

4. The water-resistant electric lamp assembly of claim 3, wherein one of the plurality of internal electrical conductors is disposed in an aperture of the first plurality of apertures, and the respective aperture in the second plurality of apertures is adapted to receive an external electrical conductor that, when disposed in the respective aperture in the second plurality of apertures, is in electrical communication with the one of the plurality of internal electrical conductor conductors.

5. The water-resistant electric lamp assembly of claim 4, wherein, when the one of the plurality of internal electrical conductors and the external electrical conductor are in electrical communication, an electrical connection between the one of the plurality of internal electrical conductor conductors and the external electrical conductor occurs inside the gasket.

6. The water-resistant electric lamp assembly of claim 3, wherein the first plurality of apertures are wider than the second plurality of apertures.

7. The water-resistant electric lamp assembly of claim 3, wherein the light source comprises a bottom surface, and at least one aperture of the first plurality of apertures is sized for and configured to receive the bottom surface, and at least one aperture of the second plurality of apertures is sized for and configured to receive an external electrical conductor.

8. The water-resistant electric lamp assembly of claim 2 further comprising an external conductor, wherein at least one internal conductor and the external conductor are received into a slit of the one or more slits and are in electrical communication inside the slit of the one or more slits.

9. The decorative lighting system of claim 1, wherein the gasket is composed of a deformable material such that each slit can deform from an original shape to accommodate lateral passing of the at least one internal electrical conductor from outside the gasket and into the channel via the corresponding slit and return to their original shape.

10. The water-resistant electric lamp assembly of claim 2, wherein the gasket is composed of a deformable material such that each slit can deform from an original shape to accommodate lateral passing of one of the plurality of internal electrical conductors through the corresponding slit and return to their original shape.

11. A decorative lighting system comprising:

a power source;

at least one external electrical conductor;

at least one light string comprising a plurality of water-resistant electric lamp assemblies, each of the plurality of water-resistant electric lamp assemblies comprising:

a lamp base having an upper end, a lower end having a bottom surface, and a sidewall disposed therebetween, the sidewall and bottom surface creating a hollow cavity inside the lamp base;

an outer bulb detachably attachable to the lamp base;

a light source;

at least one internal electrical conductor; and a gasket adapted for placement into the hollow cavity, the gasket comprising a top surface having a first plurality of apertures and a bottom surface having a second plurality of apertures, wherein each aperture in the first plurality of apertures corresponds to a respective aperture in the second plurality of apertures to create a channel running between the respective aperture pair, each channel comprising a slit extending from an external face of the body of the gasket to the channel and configured to receive the at least one internal electrical conductor, such that the at least one internal electrical conductor is substantially surrounded by the gasket in all radially outward directions;

wherein attaching the outer bulb to the lamp base creates a waterproof seal at the top of the lamp base;

wherein placing the gasket into the hollow cavity creates a waterproof seal at the lower end of the lamp base; and wherein the at least one external electrical conductor connects the plurality of water-resistant electric lamp assemblies to the power source.

* * * * *